United States Patent [19]

Fairchild

[11] 4,236,494

[45] Dec. 2, 1980

[54] ELECTRONICALLY CONTROLLED C.D. IGNITION AND INTERLOCKING SHUT-OFF SYSTEM

[75] Inventor: Harold W. Fairchild, Galesburg, Ill.

[73] Assignee: Outboard Marine Corporation, Waukegan, Ill.

[21] Appl. No.: 944,335

[22] Filed: Sep. 21, 1978

[51] Int. Cl.[3] ..... F02P 1/00

[52] U.S. Cl. ..... 123/630 CC; 123/148 S; 123/198 DC; 56/10.5

[58] Field of Search ..... 123/148 S, 148 C, 148 CC, 123/198 DC; 56/10.5

[56] References Cited

U.S. PATENT DOCUMENTS

| | | | |
|---|---|---|---|
| 3,524,438 | 8/1970 | Janisch | 123/148 CC |
| 3,703,889 | 11/1972 | Bopig | 123/148 S |
| 3,750,378 | 8/1973 | Thorud | 56/10.5 |
| 3,900,016 | 8/1975 | Haubner | 123/148 CC |
| 3,960,128 | 6/1976 | Anderson | 123/198 DC |
| 3,980,068 | 9/1976 | Karsten | 123/198 DC |
| 4,073,279 | 2/1978 | Fox | 123/148 S |

*Primary Examiner*—Ronald B. Cox

*Attorney, Agent, or Firm*—Michael, Best & Friedrich

[57] ABSTRACT

Disclosed herein is a lawn mower comprising a grass bag and chute, and a grass discharge cover, and an internal combustion engine having operation regulated by an electronically controlled C.D. ignition and interlocking shut-off system. The system includes a charge capacitor, an ignition coil including a primary winding having a first terminal connected to the charge capacitor and having a second terminal, the ignition coil including a secondary winding which fires a spark plug to operate the engine when the charge capacitor discharges through the primary winding. The system also includes a thyristor having an anode connected to the second terminal of the primary winding, and having a cathode and a gate, the thyristor being rendered conductive when a trigger pulse is applied to the gate to allow discharge of the capacitor through the primary winding, and a trigger coil having a first end connected to the thyristor cathode and a second end, and being adapted for generating trigger pulses applied to the thyristor gate. The system also includes a plurality of interlocking switches normally closed during engine operation and connected in series relation between the trigger coil second end and the thyristor gate, each of the switch means being selectively movable to an open position to interrupt current flow and prevent application of a trigger pulse from the trigger coil to the gate. At least one of the switches moves to an open position to prevent engine operation when one of the grass bag and chute, or the grass discharge cover, is not installed in a proper position on the lawn mower.

7 Claims, 4 Drawing Figures

15
14
69a
78
16
20

16
69a
20

10
12
32
36
34
44
30
68
70
38
40
39
50
42
41
48
49
46
72
54
52
76
56
74
58
64
20
66
IGNITION SWITCH
GRASS BAG AND CHUTE (OR COVER) IN PLACE (INTERLOCK SWITCH)

14
11
18
20
69b

ELECTRONICALLY CONTROLLED C.D. IGNITION AND INTERLOCKING SHUT-OFF SYSTEM

BACKGROUND OF THE INVENTION

The invention relates to electronically controlled capacitor discharge ignition systems, and more particularly, to an interlocking shut-off arrangement for such a C.D. ignition system. Still more particularly, the invention relates to such a C.D. ignition system utilized to control the operation of an internal combustion engine for driving the cutting blade of a lawn mower, and including an interlocking shut-off arrangement operative, for example, to require that the lawn mower grass bag and chute, or grass discharge cover, be in proper position in order to operate the engine. Attention is directed to the following U.S. patents which disclose electronically controlled C.D. ignition systems having a single ignition shut-off switch:

| | | |
|---|---|---|
| Anderson | 3,960,128 | issued June 1, 1976 |
| Cavil | 4,074,669 | issued Feb. 21, 1978 |
| Haubner | 3,900,016 | issued Aug. 19 1975 |

Haubner discloses that electronically controlled C.D. ignition systems having shut-off or stopping switches are known wherein the control current to the ignition SCR is interrupted so that the SCR is no longer turned on, and hence, so that the capacitor cannot be discharged. Haubner notes that with such an arrangement, supplementary precautions must be taken to protect the ignition capacitor and SCR from excess voltage, and states that it is an object of his invention to provide a capacitor discharge ignition system with an engine stopping switch so arranged so that there is no overloading by excess voltages.

Attention is also directed to the following patents which disclose engine starting or engine operating interlocking switch arrangements for various types of lawn mowers:

| | | |
|---|---|---|
| Nofel | 3,969,875 | issued July 20, 1976 |
| Uhlinger | 4,043,102 | issued Aug. 23, 1977 |
| Thorud | 3,750,378 | issued Aug. 7, 1973 |
| Allen | 3,733,794 | issued May 22, 1973 |
| Peterson | 3,736,729 | issued June 5, 1973 |
| Harkness | 3,782,084 | issued Jan. 1, 1974 |
| Braun | 4,002,190 | issued Jan. 18, 1977 |

The interlocking switch arrangements disclosed in the patents mentioned above operate to short the magneto coil or ground the electrical system of a magneto powered engine ignition system to prevent engine operation when various lawn mower components associated with the interlocking switches, for example, grass bags or grass discharge covers, are not in their proper operating positions. Such prior art interlocking switch arrangements, which require shorting of the electrical system to stop engine operation, are subject to failure if a wire breaks or an electrical connection opens because the circuit can not be completed to provide the short circuit required to stop engine operation.

SUMMARY OF THE INVENTION

The invention disclosed herein provides a lawn mower comprising an electronically controlled C.D. ignition and interlocking shut-off system including a charge capacitor, an ignition coil including a primary winding, a thyristor connected in circuit with the charge capacitor and the primary winding, the thyristor having a gate and being rendered conductive when a trigger pulse is applied to the gate to allow discharge of the capacitor through the primary winding, and a plurality of interlocking switch means each selectively movable to an open position to interrupt current flow and prevent application of a trigger pulse to the gate, thereby selectively preventing discharge of the charge capacitor through the primary winding.

The invention disclosed herein also provides an electronically controlled C.D. ignition and interlocking shut-off system comprising a charge capacitor, an ignition coil including a primary winding, a thyristor connected in circuit with the charge capacitor and the primary winding, the thyristor having a gate and being rendered conductive when a trigger pulse is applied to the gate to allow discharge of the capacitor through the primary winding. The system also includes a plurality of interlocking switch means each selectively movable to an open position to interrupt current flow and prevent application of a trigger pulse to the gate, thereby selectively preventing discharge of the charge capacitor through the primary winding.

In accordance with an embodiment of the invention, the system further comprises means, preferably in the form of a varistor, connected in parallel with the charge capacitor to prevent excess voltage from being developed across the capacitor when one of the switch means moves to an open position.

Also in accordance with an embodiment of the invention, such a system is provided wherein the thyristor includes an anode connected to one end of the primary winding, and includes a cathode, and wherein the system further comprises a trigger coil adapted to generate trigger pulses applied to the thyristor gate, and having a first end connected to the thyristor cathode and having a second end, and wherein the plurality of interlocking switch means are electrically connected in series relation between the second end of the trigger coil and the thyristor gate. Preferably the thyristor gate is connected to ground, and the plurality of interlocking switch means are connected in series relation to and between the second end of the trigger coil and ground.

The invention also provides a lawn mower comprising a grass bag and chute, and a grass discharge cover, and an internal combustion engine having operation regulated by an electronically controlled C.D. ignition and interlocking shut-off system, the system including a charge capacitor, and an ignition coil including a primary winding having a first terminal connected to the charge capacitor and having a second terminal, the ignition coil including a secondary winding which fires a spark plug to operate the engine when the charge capacitor discharges through the primary winding. The system also includes a thyristor having an anode connected to the second terminal of the primary winding, and having a cathode and a gate, the thyristor being rendered conductive when a trigger pulse is applied to the gate to allow discharge of the capacitor through the primary winding, a trigger coil having a first end connected to the thyristor cathode, and having a second end, and being adapted for generating trigger pulses applied to the thyristor gate, and a plurality of interlocking switch means normally closed during engine operation and connected in series relation between the trigger coil second end and the thyristor gate, each of the switch means being selectively movable to an open position to interrupt current flow and prevent application of a trigger pulse from the trigger coil to the gate, at least one of the switch means moving to an open position to prevent engine operation when one of the grass bag and chute, or the grass discharge cover, is not installed in a proper position on the lawn mower.

One of the principal features of the invention is the provision of a lawn mower including an electronically controlled C.D. ignition and interlocking shut-off system which includes a plurality of interlocking switch means normally closed to complete the gate circuit of an ignition thyristor or SCR to enable engine operation.

Another of the principal features of the invention is to provide a lawn mower having such an ignition and interlocking shut-off system that is not subject to failure if a wire breaks or an electrical connection opens.

Another of the principal features of the invention is the provision of a lawn mower including such an ignition and interlocking shut-off system wherein the engine can not be started or operated unless one of a grass bag and chute, or a grass discharge cover, is installed in proper position on the lawn mower.

Other features and advantages of the embodiments of the invention will become apparent to those skilled in the art upon reviewing the following detailed description, the drawings, and the appended claims.

DRAWINGS

Figure 2:
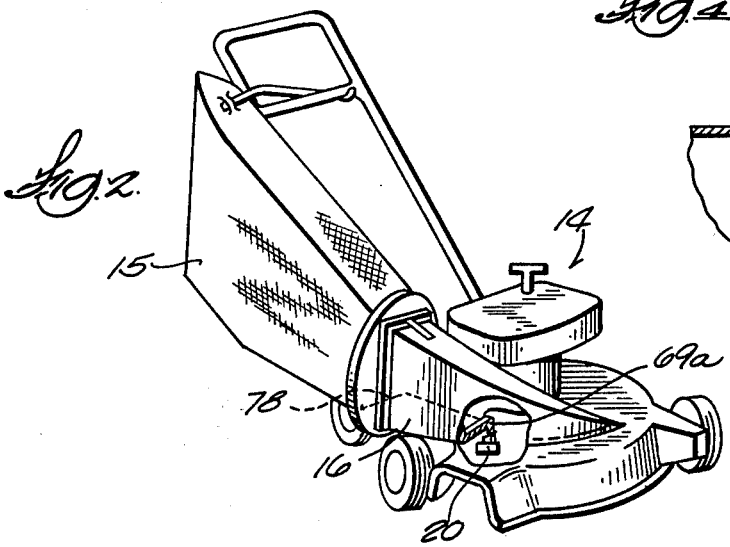
FIG. 2 is a diagrammatic view of a lawn mower shown with a grass bag and chute installed in proper position, and which incorporates the ignition and interlocking shut-off system shown in FIG. 1.

Before explaining the embodiments of the invention in detail, it is to be understood that the invention is not limited in its application to the details of construction and the arrangements of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
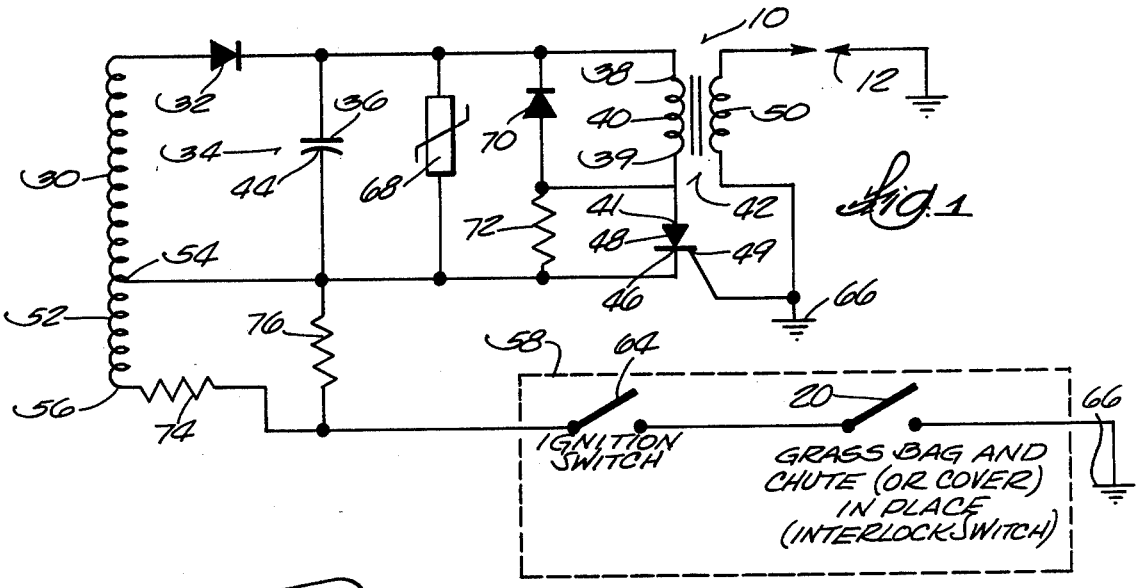
FIG. 1 is a schematic view of an electronically controlled capacitor discharge ignition and interlocking shut-off system which embodies various features of the invention.
Figure 3:
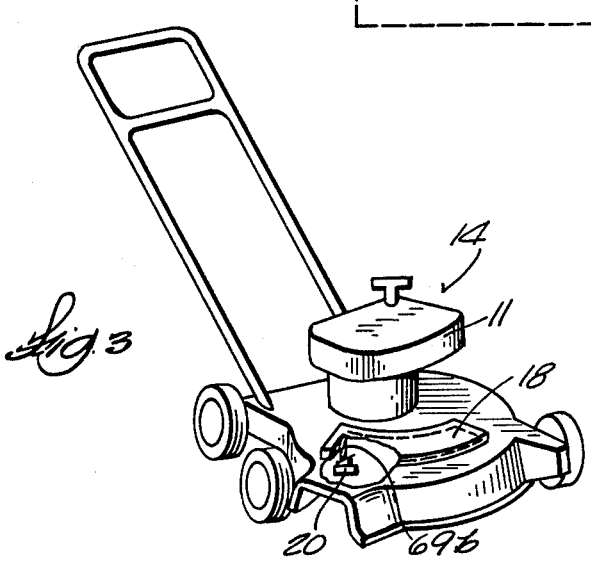
FIG. 3 is a view of the lawn mower of FIG. 2 shown with a grass discharge cover installed, instead of the grass bag and chute.

Shown in FIG. 1 is an electronically controlled capacitor discharge ignition and interlocking shut-off system 10 which can be utilized to regulate the operation of an internal combustion engine 11 having a spark plug 12 and which is suitable for driving the cutting blade (not shown) of a lawn mower 14 shown in FIGS. 2 and 3. The lawn mower 14 is diagrammatically shown in FIG. 2 to include a properly installed grass bag 15 and chute 16 and is alternatively shown in FIG. 3 to include a properly installed grass discharge cover 18. Proper installation of one of the grass bag and chute, 15 and 16, or the grass discharge cover 18, results in actuating an interlock switch 20 (described in more detail below) to a closed position so that the internal combustion engine 11 can be started and operated.

Returning to a description of the system 10, a charge coil 30 is connected to a diode 32 and a charge capacitor 34 so that when a rotating magnet, for example, mounted on flywheel (not shown) induces flux in the charge coil 30, the capacitor 34 is charged. One end, 36, of capacitor 34 is connected to one end, 38, of a primary winding 40 of an ignition coil 42. The opposite end 39 of the primary winding 40 is connected to an anode 41 of a thyristor 48 which also includes a gate 49 connected to ground which is designated 66. The opposite end 44 of the capacitor 34 is connected to a cathode 46 of the thyristor 48 so that when thyristor 48 is gated, the capacitor discharges through the primary winding 40 and the thyristor 48, thereby inducing a high voltage in the secondary winding 50 of the ignition coil 42 to fire the spark plug 12 and operate the engine 11.

The system 10 includes a trigger coil 52 having one end 54 connected to the thyristor cathode 46 and having an opposite end 56 connected to a plurality of interlocking switch means, generally designated 58, normally closed during engine operation, and which preferably includes the interlock switch 20 and an on-off ignition switch 64 connected in series relation to and between the trigger coil opposite end 56 and ground 66. The trigger coil 52 is adapted for generating trigger pulses conveyed to the gate 49 of the thyristor 48 when flux is induced in the trigger coil 52 by a rotating magnet (not shown). The thyristor 48 is gated by the trigger pulses and hence, the charge capacitor discharged, only if both the ignition switch 64 and the interlock switch 20, included in the gate circuit, are closed so that the gate circuit, also including the trigger coil 52 and cathode-gate junction of thyristor 48, is completed.

Excess voltage prevention means, preferably in the form of a varistor 68, is connected in parallel with the charge capacitor 34 to prevent excess voltages from being developed when one or both of the interlocking switch means are open. The ignition system 10 is completed by a free wheeling diode 70 connected in parallel with the primary coil 40, and by resistors 72, 74, and 76, connected in circuit as shown in FIG. 1.

As noted, during engine operation, the interlock switch 20 and ignition switch 64 must be closed in order for the thyristor 48 to be gated. As shown diagrammatically in the illustrated construction, the interlock switch 20 is mounted and arranged on the lawn mower 14 so that if one of the grass bag and chute 16, or the grass discharge cover 18, it not installed in a proper position on the lawn mower, the switch 20 opens, thereby interrupting current flow to prevent application of a trigger pulse from the trigger coil to the thyristor gate.

Figure 4:
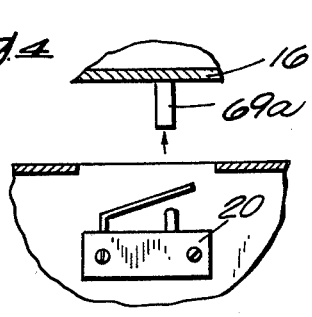
FIG. 4 is an enlarged partial diagrammatic view of an interlock switch included in the system shown in FIG. 1 and mounted on the lawn mower shown in FIG. 2.

More particularly, as shown diagrammatically in FIGS. 2–4, the lawn mower 14 includes the interlock switch 20 mounted thereon, so that an actuator **69*a*, mounted to the underside of the grass chute 16, (FIGS. 2 and 4) or an actuator 69*b*, mounted to the underside of the grass discharge cover 18 (FIG. 3) moves the interlock switch 20 to a closed position when one of the grass bag 15 and chute 16, or the grass discharge cover 18, is mounted in proper position on the lawn mower. While the actuator 69*a* shown in FIG. 2 is connected to the grass chute 16, it is to be understood that, although other arrangements could be utilized, the grass bag 15 is linked to the grass chute 16 by a suitable linkage or arrangement 78, shown in dotted line, so that both the grass bag 15 and the chute 16 must be in proper position in order for the actuator 69***a* to close the interlock switch 20.

It is to be understood that the grass bag and chute and actuator 69*a*, and the grass discharge cover 18 and actuator 69*b*, are only shown diagrammatically, and any suitable actuator and switch arrangement could be utilized in the illustrated construction, so long as the interlock switch 20, which must be actuated to a closed position to enable and maintain engine operation, moves to an open position if one of the grass bag and chute, or the grass discharge cover, is not mounted in proper position on the lawn mower.

Thus, if one of the grass bag and chute, or the grass discharge cover, are not in the proper position, and hence, the interlock switch 20 is open, the capacitor 34 cannot discharge through the primary winding 40, and the engine 11 cannot be started or operated. Of course, the ignition switch 64 must also be in a closed position in order for the engine to be operated. As noted, the specific details of the arrangements by which the interlock switch means are operated are not shown, since any suitable arrangements could be utilized.

Also, while the interlock switch 20 has been described as being actuated by a grass bag and chute, or by a grass discharge cover, it is to be understood that additional interlocking switch means or a different plurality of interlocking switch means could be utilized. For example, the interlocking switch means 58 could include a neutral position switch, or an engine cover switch, or some other switch actuated by a movable lawn mower component that could present a safety hazard if not in its proper position. It is necessary, however, that in order to enable and maintain engine operation, the plurality of interlocking switch means must be actuated to and be maintained in closed positions when the associated lawn mower components are in proper position.

Thus, if a mower component is not in proper position, the thyristor gate circuit is open, thereby preventing or stopping engine operation. Since the plurality of series connected interlocking switch means are all required to be closed during engine operation, a broken wire or open connection results in the engine not being able to be operated. Thus, the C.D. ignition and interlocking shut-off system 10 includes a plurality of interlocking switch means to reliably regulate starting and operation of the engine.

Various of the features of the invention are set forth in the following claims.

What is claimed is:

1. A lawn mower comprising an electronically controlled C.D. ignition and interlocking shut-off system including a charge capacitor, an ignition coil including a primary winding, a thyristor including an anode connected to one end of said primary winding, and including a cathode, and a gate connected to ground, said thyristor being rendered conductive when a trigger pulse is applied to said gate to allow discharge of said capacitor through said primary winding, a trigger coil adapted to generate trigger pulses applied to said thyristor gate, and having a first end connected to said thyristor cathode and having a second end, and a plurality of interlocking switch means electrically connected in series relation between said second end of said trigger coil and ground, each of said switch means being selectively movable to an open position for interrupting current flow and preventing application of a trigger pulse to said gate, thereby selectively preventing discharge of said charge capacitor through said primary winding.

2. A lawn mower comprising an electronically controlled C.D. ignition and interlocking shut-off system including a charge capacitor, an ignition coil including a primary winding, a thyristor connected in circuit with said charge capacitor and said primary winding, said thyristor having a gate connected to ground and being rendered conductive when a trigger pulse is applied to said gate to allow discharge of said capacitor through said primary winding, a trigger coil adapted to generate trigger pulses applied to said thyristor gate, and having a first end connected to said thyristor cathode and having a second end, and a plurality of interlocking switch means each selectively movable to an open position to interrupt current flow and prevent application of a trigger pulse to said gate, thereby selectively preventing discharge of said charge capacitor through said primary winding.

3. A lawn mower comprising a grass bag and chute, and a grass discharge cover, and an internal combustion engine having operation regulated by an electronically controlled C.D. ignition and interlocking shut-off system, said system including a charge capacitor, an ignition coil including a primary winding having a first terminal connected to said charge capacitor and having a second terminal, said ignition coil including a secondary winding which fires a spark plug to operate said engine when said charge capacitor discharges through said primary winding, a thyristor having an anode connected to said second terminal of said primary winding, and having a cathode, and a gate connected to ground, said thyristor being rendered conductive when a trigger pulse is applied to said gate to allow discharge of said capacitor through said primary winding, a trigger coil having a first end connected to said thyristor cathode and a second end, and being adapted for generating trigger pulses applied to said thyristor gate, and a plurality of interlocking switch means normally closed during engine operation and connected in series relation between said trigger coil second end and ground, each of said switch means being selectively movable to an open position to interrupt current flow and prevent application of a trigger pulse from said trigger coil to said gate, at least one of said switch means moving to an open position to prevent engine operation when one of said grass bag and chute, or said grass discharge cover, is not installed in a proper position on said lawn mower, said lawn mower further comprising means connected in parallel with said charge capacitor to prevent excess voltage from being developed across said capacitor when one of said switch means moves to an open position.

4. A lawn mower in accordance with claim 1 further comprising means connected in parallel with said charge capacitor to prevent excess voltage from being developed across said capacitor when one of said switch means moves to an open position.

5. A lawn mower in accordance with claim 4, wherein said excess voltage prevention means comprises a varistor.

6. A lawn mower in accordance with claim 2 and further comprising means connected in parallel with said charge capacitor to prevent excess voltage from being developed across said capacitor when one of said switch means moves to an open position.

7. A lawn mower in accordance with claim 6, wherein said excess voltage prevention means comprises a varistor.

* * * * *